United States Patent [19]

Bacher et al.

[11] Patent Number: 4,981,445

[45] Date of Patent: Jan. 1, 1991

[54] INEXPENSIVE COAXIAL MICROWAVE CONNECTOR WITH LOW LOSS AND REFLECTION, FREE OF SLOTTED-PIN EXPANSION PROBLEMS

[76] Inventors: Helmut Bacher, 10952 Sweet Oak St., Cupertino, Calif. 95014; Egon R. Seitter, Timber Hill Ct., Dexter, Mich. 48130

[21] Appl. No.: 239,987

[22] Filed: Sep. 1, 1988

[51] Int. Cl.[5] ..... H01R 17/18

[52] U.S. Cl. ..... 439/578; 439/736; 439/675

[58] Field of Search ..... 439/578–585, 439/675, 736; 333/245, 246, 260, 261

[56] References Cited

U.S. PATENT DOCUMENTS

| | | | |
|---|---|---|---|
| 3,683,320 | 8/1972 | Woods et al. | 439/584 |
| 4,326,769 | 4/1982 | Dorsey et al. | 439/578 |
| 4,456,324 | 6/1984 | Staeger | 439/578 |
| 4,648,683 | 3/1987 | Botka | 439/583 |
| 4,718,864 | 1/1988 | Flanagan | 439/578 |

FOREIGN PATENT DOCUMENTS

| | | | |
|---|---|---|---|
| 664271 | 11/1965 | Belgium | 439/580 |
| 1440177 | 12/1968 | Fed. Rep. of Germany | 439/583 |

*Primary Examiner*—David Pirlot

*Attorney, Agent, or Firm*—Michael J. Hughes; Peter I. Lippman

[57] ABSTRACT

A unitary three-vane support bead (30) detunes the lowest-frequency transverse cavity modes, forcing resonances toward higher frequencies. Its impedance, compared with that of prior solid beads, is closer to the impedance of an air line. The bead is injection-molded in place, with a radial boss (35) at the radially outer end of each vane (32). Three apertures (14) in the outer conductor (11) capture the bosses, for economical but secure mounting; in fabrication these three apertures serve as injection gates. On its end (29) facing a mating device (**65, 65*f*), the central conductor (21) has an axial bore (26) that holds a cylindrical sheet-metal spring (50). The outward-facing edge (56) of this spring protrudes slightly from the bore and is trimmed to form three distinct contact areas (52), each of relatively small circumferential extent, for kinematically stable engagement with the mating-device central pin (65). Either that pin or the central conductor (21**) may penetrate the other, but only to help align them for mating, not to actually make contact. Thus there is no dependence on male-pin diametral tolerance, or on holding small interior axial clearances; and either a slotted or an unslotted female pin may be used without incurring the dimensional-variation problems of prior slotted pins.

31 Claims, 2 Drawing Sheets

INEXPENSIVE COAXIAL MICROWAVE CONNECTOR WITH LOW LOSS AND REFLECTION, FREE OF SLOTTED-PIN EXPANSION PROBLEMS

BACKGROUND

1. Field of the Invention

This invention relates generally to microwave coaxial connectors; and more particularly to connectors that can be mass produced very economically but that have extremely (and reliably) low reflections and losses.

2. Developments in This Field

It has been realized for some decades that in coaxial-connector performance a major limiting factor, comparable in importance to direct reflection and dielectric loss, is connector susceptibility to transverse cavity-mode resonances. Resonances too reflect and absorb power, thereby increasing voltage standing-wave ratio (VSWR) values and degrading transmission.

For example, the coaxial-connector cavity-resonator problem is discussed in U.S. Pat. No. 3,340,495, issued Sept. 5, 1967, and entitled "Ultra-High Frequency Connector"—of which one of the present inventors was a patentee (as coinventor with Weinschel and Elste). In qualitative terms, the general presentation of the cavity-resonance problem in that patent remains valid today.

At that time, however, 18 GHz was considered an ultrahigh frequency, and reflections of perhaps 30 dB below the signal level were regarded as negligible. Since then, frequency demands have increased steadily in a bandwidth-starved technology. Meanwhile demands for precision in microwave instrumentation, and especially in microwave metrology, have escalated continuously.

As a result, state-of-the-art frequency requirements now extend from 26 GHz to well above 60 GHz. Furthermore, in some situations, discontinuities as much as 55 to 60 dB below the signal level are considered significant.

Consequently, minuscule variations in component dimensions during connector mating have become major problems. Thus the connector manufacturer is squeezed for inhumanly tiny tolerances, but also at the same time for price—which is to say, for the utmost in economy, reliability, and yield in the manufacturing process.

A coaxial connector must perform two functions' it must provide contact between the central conductors (and between the outer conductors) of two mating devices; and it must provide support for each central conductor within its outer conductor. In analyzing the limiting factors of coaxial-connector configurations, it is helpful to consider separately the contact function and the support function.

The contact function

The present state of these problems is represented well in a "Technical Note" written by Julius Botka, and published just six months ago—in the March 1988 *Microwave Journal.* Mr. Botka explains that for good metrology in the microwave field it is necessary to eliminate "the interdependence of the two connectors on either side of the interface".

Mr. Botka focuses upon the contact function, and identifies the slotted female contact as a "major source of connector interdependence in pin/socket type connectors" of certain types. As he explains, this problem arises because of the interference fit between the slotted female pin or conductor and the mating male pin or conductor.

This interference fit causes the inside diameters of slotted female pins to conform to the outside diameters of inserted male pins. Diametral variation of the male pins is thereby transferred to the slotted female pins, Botka says. (Presumably that diametral variation is combined with the variability in diameters and wall thicknesses of the female pins themselves.)

He gives an example in which a pin-diameter change of 0.0004 inch (four ten-thousandths of an inch) can introduce an error offset of 44 dB (forty-four decibels) at 26.5 GHz. This example relates to a connector in which the allowable variation of pin diameter is 0.0006 inch.

Botka's response to this type of problem, as presented in the same Technical Note, is a female pin design that is unslotted. It thus completely avoids the variability of diameter introduced by slotted female pins whose inside diameters conform to the outside diameters of inserted male pins.

Unslotted-pin configurations may be considered preferable for other reasons. For one, the slotted pin introduces added complexity into the impedance analysis, and thereby introduces added constraints on the overall design of mating parts.

As shown in the left-hand portion of FIG. 6 herein, the Botka slotless pin 121 incorporates a metal spring 51 that is secured within an axial bore 126 in the end of the pin 121. The axial bore 126 has an inward-directed lip or flange **129*i*** at its outermost end, thus requiring undercut tooling (or at the very least touchy metal-casting procedures).

The metal spring 151 is rolled up and captured within the axial bore 126, inside the lip **129*i*. In fact, the spring 151 is required to reliably engage, in the axial direction, the interior of the bore 126 circumferentially about the inside edge of the lip 129*i* —and to do so while at the same time radially engaging the inserted male pin 166** circumferentially about generally the same transverse plane.

Such performance is demanding, particularly since—as stated in the Technical Note—this design relies upon the axial clearance between the spring insert 151 and the flush outer end face 129 of the female pin 121 to prevent current from entering the interior of the female pin 121. In this way the designers seek to avoid "the extra inductance of a so-called 'hooded' contact".

At best, the inductance of this new Botka design is the inductance of this combination of features: (1) the relatively large full diameter of the uninserted portion 165 of the male pin, in series with (2) the radial face or step **165*f* of the uninserted portion 165 of the male pin, then (3) a short section of the small-diameter cylindrical surface 166 of the male pin 165—at the diameter corresponding to the inside diameter of the inward-directed lip 129*i* in the female pin 121—and then (4) the radial face 129 of the female pin 121 and finally (5) the larger-diameter cylindrical surface 127 of the female pin 121**.

In other words, the microwave energy traverses a deep, wide groove that defines a large annular area. Those skilled in the art of microwave components will readily recognize such a combination as a relatively high-inductance geometry.

Another less recent—and less satisfactory—approach to the contact problem is presented in U.S. Pat. No.

4,397,515, which issued to Thomas Russell in August 1983. Interestingly, Russell's point of departure is a competing device of the Wiltron Company, in which a slotted pin is sheathed within an outer unslotted pin.

The Wiltron unit presumably has the advantages of an unslotted pin; but Russell rejects that configuration in favor of his own opposite design—an inner unslotted pin sheathed within an outer slotted pin. Thus Russell in 1983 was teaching away from the general form of a solution adopted by Botka in 1988.

As presented by Russell, the Wiltron configuration had the drawbacks of difficulty and cost in manufacture, "requiring extremely tight dimensional tolerances and complicated twisted biasing of the fingers." Russell's geometry, however, although solving breakage difficulties and overcoming the complexities of the Wiltron device, must have the same sensitivity to male-pin diameter variation as other, simpler slotted-pin connectors.

The support function

Two 1984 United States patents offer representative developments in microwave coaxial-connector support: U.S. Pat. No. 4,456,324 to Staeger, and U.S. Pat. No. 4,431,255 to Banning. The Staeger configuration seems the better of the two in terms of performance, although it remains limited in that area. Nevertheless the design disclosed in the Staeger patent appears to suffer its most severe drawbacks in the area of cost.

A major problem of the support funcion is dielectric loss. Staeger seeks to achieve a connector impedance whose loss component is as close as possible to that of an air-line (in other words, a coaxial line with no support at all).

For this purpose he uses supports in the shape of very thin but stiff dielectric leaves or foils, oriented edge-on toward the oncoming radiation. His connector has four of these foil struts, each curved through a right angle and wedged in place between the central conductor and the outer conductor.

The two free ends of each foil radially abut the interior of the outer conductor. The curved central portions of the four foils press toward each other near the center of the connector to form a capture framework for the central conductor. The central conductor is optionally made square, to stabilize it between the counteropposed central segments of the four foils.

Staeger's ingenious design, by virtue of the very thin edge-on construction of the support members, probably has favorably low loss—that is, a relatively high resistive component of shunt impedance—perhaps approaching that of an air line as desired. As will be evident, however, due to its elaborate assembly requirements it has a very unfavorable cost.

In addition the Staeger support system has a more insidious drawback in terms of VSWR. The recognition of this particular drawback is more properly regarded as a preliminary part of the process of making our present invention, and it therefore will be discussed below in connection with our invention.

Somewhat less relevant is the Banning patent, which is directed to the specialized support problem of stabilizing the tines of a slotted female pin against transverse forces developed in connector mating. Banning describes and criticizes prior devices in which the slotted-pin tines are stabilized within support beads that are loose radially (i. e., that have a thin annular air gap)—even though the beads surround the slotted segments in a generally continuous fashion axially.

Banning's solution to this problem is to separate this auxiliary tine-stabilization function from the primary central-pin-support function. His support bead is axially short, and spaced back well away from the mating connector.

In particular, the support bead is injection-molded in place well behind the slotted portion of the central pin, and thus does not participate at all in stabilizing the slotted-pin tines. Banning also provides, however, another annular dielectric structure particularly devoted to the tine-stabilizing function.

This tine stabilizer surrounds the tips of the slotted-pin tines, and is close enough to them to prevent radical distortion of the tines in the connector-mating process. The stabilizer is spaced from them radially, however, far enough to prevent contact after the connector has been nondestructively mated and the system placed in operation.

In dealing with the support problem, neither Staeger nor Banning addresses the contact problem as such—that is, the problem of avoiding discontinuities and reflections in the central-pin contact region. Staeger employs a nonslotted central conductor, with no particular provision for obtaining positive contact; whereas Banning uses a slotted central pin, with no apparent awareness of the diametral-variation problem later discussed very recently by Botka.

As can be seen, the prior art accordingly fails to deal in an entirely satisfactory way with either the contact function or the support function. Still further specific failings of prior devices, affecting primarily the support function, have been recognized as part of our inventive steps in the present invention and will be presented below.

SUMMARY OF THE DISCLOSURE

Our invention is a microwave coaxial connector. It includes an annular outer conductor, and a central conductor that is at least partially disposed within the outer conductor. The invention also includes a support bead for holding the central conductor substantially coaxially within the outer conductor.

We have recognized that support bead geometries having even symmetry, such as that of Staeger described above, are susceptible to transverse resonances in low-order modes, following the structural symmetry. In this regard the extreme thinness of the Staeger support struts is to no avail.

In a first group of preferred forms or embodiments of our invention, based upon this recognition, the support bead is a unitary article that is injection-molded in position between the conductors. It comprises an odd number of spokes or support vanes extending radially between the outer and central conductors. The support bead also defines an odd number of air spaces between the vanes.

This use of an odd number of vanes deters electrical resonance at the support bead in the lowest-order transverse mode—which is characterized by an even number of symmetrical lobes. Resonance in transverse modes in the region of the support bead is thereby forced to relatively higher frequencies, significantly alleviating reflections and VSWR problems.

For definiteness in this document, this first group of preferred embodiments will be illustrated and discussed primarily in conjunction with pins or central conductors whose geometry is female. This group of embodiments, however, is equally usable and useful for male conductors or genderless conductors.

In a second group of preferred embodiments of our invention, the connector includes some means for effecting positive mechanical and electrical contact between the central conductor and the central pin of a mating device. For purposes of generality of expression in describing our invention, we shall call these means the "contact-effecting means."

The contact-effecting means create or effect contact at a number of well-defined contact areas, each area being of relatively small circumferential extent. The contact-effecting means perform their function substantially without depending upon interference-fit penetration of either the central conductOr or the mating central pin by the other. In fact, our invention is entirely compatible with genderless pin structures.

Loose penetration of a very thin central forward segment, however, is permitted for compliance with certain established specifications. Since the mating male central pin, if present, only fits within the female pin loosely, two important advantages are obtained in operation of this second group of preferred embodiments.

First, the female central conductor does not undergo substantial radial expansion upon contact. Accordingly the reactance is independent of male-pin diametral variation.

Secondly, by virtue of operation without reliance on fixed dimensional relations of penetration, the combined reactance of the coaxial connector and the mating device is also substantially independent of axial clearances internal to the central conductor. This independence is highly desirable—and a monumental achievement, since the reactance of prior devices has been extremely and notoriously sensitive to internal axial clearances.

In variant forms of the second-mentioned group of embodiments, the central conductor defines along its axis a bore that is open axially in a direction toward the mating device. The connector also includes a contact element which in turn comprises a sheet-metal spring that is bent into a generally cylindrical or spiral shape.

This spring is inserted into the axial bore of the central conductor. A portion of the contact element extends outward axially from the central conductor for contact with the central pin of the mating device.

The foregoing may be a discussion of the preferred embodiments of our invention in their most general or broad form. As will be apparent, however, the features of these two groups of embodiments, including the variant forms of the second group, are not mutually exclusive; they may be incorporated together in a single connector.

We prefer to combine these groups of embodiments in that way. Further, for greatest enjoyment of the potential benefits of the invention we prefer to incorporate certain other advantageous characteristics or features.

We shall first discuss such features related to the support structure, involved in the first-mentioned group of embodiments. For example, we prefer to make the previously mentioned odd number of spokes or support vanes equal to three.

We also prefer that each support vane include at its radially outer end a base that is relatively broad circumferentially. This base provides ample surface area for stable engagement with an inner surface of the outer conductor.

In addition we prefer that each vane include in its radially central region (that is, the region partway out from the axis of the connector to the outer end or base of the vane) a relatively narrow portion. By "narrow" here we mean thin in the circumferential direction; we shall accordingly describe this portion as a "web" portion.

These relatively narrow web portions leave the greater part of the circumference of the annular space between the conductors for air spaces. Each vane tapers smoothly between its relatively narrow web and its relatively broad base.

We also prefer that the support bead include a generally cylindrical hub portion. The hub is the radially innermost portion of the bead, and is common to all the vanes.

Preferably the hub is substantially continuous circumferentially, for firm engagement about an outer surface of the central conductor. Preferably each support vane tapers smoothly between its relatively narrow web and the common hub portion.

It is also our preference to form in the outer conductor an odd number of apertures that are substantially aligned circumferentially with the vanes. Correspondingly we prefer to form in each vane a unitary boss that extends radially outward and is securely seated in a corresponding one of the apertures.

Now we shall turn to certain preferred features of the contact structure that is involved in the second group of embodiments introduced above. We prefer to make the number of contact areas equal to three: this choice produces kinematically stable engagement between the central conductor and mating central pin. Preferably the part of the contact element which makes three-point contact is a shaped portion of the sheet-metal spring.

In such a structure the spring is shaped along one edge to form the well-defined contact areas in the outward-extending, outward-biased portion of the contact element. Thus the sheet-metal spring axially biases its own formed portion toward axial contact with the mating central pin.

We have already pointed out advantageous properties of the odd number of support-bead vanes, and the three contact areas. Our invention, however, has several other important advantages.

Pin-to-pin contact areas are formed along a contact pattern of relatively large diameter—nearly equal to the outside diameter of the central conductor. This feature makes inductance in the contact region much less than for the recently proposed Botka configuration which is discussed above.

Because the contact areas are well defined and positively engaged, repeatability of this novel connector is very high. Furthermore, in this configuration low contact pressure is easily achieved, providing high wear resistance and extended life.

Sensitivity to eccentricity within the central conductor is quite small—particularly in comparison with designs (such as that in the left-hand portion of FIG. 6) involving elaborate compound-diameter internal structure of the central conductor. Because of this low sensitivity to eccentricity, our invention reduces the stringency of manufacturing tolerances and accordingly the cost.

Configuration of the support bead for injection-molding in place between the two conductors permits automated manufacture of the entire assembly ready for use in one piece, except for the easily inserted contact element. Therefore the connector of our invention can be mass-produced in high volume very inexpensively.

Because a large fraction of the space within the connector is reserved for air, the effective dielectric constant is low. This characteristic permits use of the high-temperature plastic for the support bead—and in conjunction with the previously mentioned preclusion of low-order transverse modes gives the connector superb electrical performance.

Very secure capture of the bead within the outer conductor is achieved, with no added cost, by making the boss-engaging apertures serve double duty as injection ports. Furthermore, electrical discontinuity introduced by this arrangement is negligible.

All of the foregoing operational principles and advantages of our invention will be more fully appreciated upon consideration of the following detailed description, with reference to the appended drawings, of which:

DETAILED DESCRIPTION OF THE PREFERRED EMBODIMENTS

Figure 1:
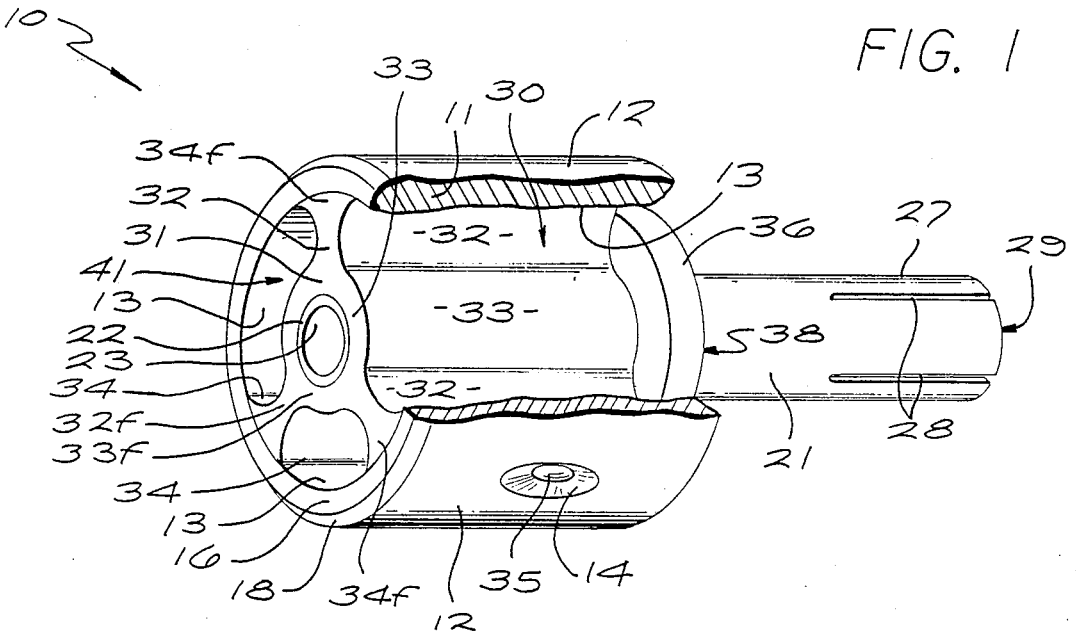
FIG. 1 is an isometric view of one preferred embodiment of our invention.

As shown in FIG. 1, a preferred embodiment of the main assembly 10 of our connector invention includes an annular outer conductor 11, central inner conductor 21, and interconnecting support bead 31. The assembly 10 also has an optional thin forward wall 36, which can be included—at a slight cost in electrical performance—where important to seal the attached cable against moisture and other contaminants.

The outer conductor 11 is a metal ring or annulus with three small, circumferentially spaced circular apertures. These apertures are each formed about halfway along the length of the annulus. The conical countersink 14 of one of these apertures appears in FIG. 1.

The outer conductor 11 has generally cylindrical exterior and interior surfaces 12 and 13 respectively. Between these cylindrical surfaces, the outer conductor 11 presents to the mating connector device a planar annular forward face 38.

At a rearward end of the outer conductor is another annular and planar face 16, which is preferably separated from the exterior surface 12 by a narrow annular break or bevel 18*s*. As will be seen, a like annular outer bevel is provided at the forward face 38.

The central conductor 21 has a forward face 29 and an axial bore (not shown in FIG. 1) formed through that face—but penetrating only partway through the length of the conductor 21. The forward face 29 and its axial bore together form an annular forward skirt 27 in which are optionally defined longitudinal slots 28.

Thus our invention may include a slotted female pin if desired. For reasons that will be explained shortly, our invention is strongly resistant if not immune to the dimensional-variation problems discussed by Botka. As will become clear, however, our invention is entirely usable without such slotting, thereby perhaps optimizing the desired benefits of nonslotted configurations.

Similarly at a rearward end of the central conductor is another planar face 22. Formed in this face 22 is another axial bore 23, for use in securing the central conductor of a coaxial cable or other microwave circuit element.

We prefer to thread this bore 23, a step readily accomplished with a screw machine during preliminary manufacture of the conductor 21. The threads can be used for screw-in attachment of a specialized rear fitting or adapter, to accommodate the particular microwave coaxial component which the connector terminates. This strategy permits connector manufacturers, distributors, warehousers and users to deal with just one connector style, rather than many.

For example, if the connector will be used to terminate a coaxial cable, the separate adapter that is screwed to the bore can advantageously provide pressure fingers for gripping the center conductor of the cable. If the connector will terminate a so-called "microstrip launch," used for interfacing a coaxial connector with an integrated circuit, amplifier, or the like, the adapter can advantageously include a corresponding spring-and-plunger system.

Injection-molded in position between the outer and central conductors 11 and 21, to mutually support them in a fixed coaxial relationship, is the support bead 31. The bead 31 does not fill the entire annular space between the two conductors, but rather occupies only a relatively small fraction of that space—leaving large voids 41.

These relatively large voids 41 very usefully impart to the connector an impedance and particularly a loss characteristic which favorably approach those of an air line. As suggested above, the optional forward seal 36 if present degrades these properties, but because of its thinness does so only slightly.

Accordingly the bead 31 includes radial spokes or vanes 32, extending between the conductors 11, 21. Each vane 32 has a generally planar frontal or forward face 38, and a like rearward face 32*f*.

If as mentioned above a forward wall 36 is present, the forward surface of that wall 36 forms a part of the frontal or forward face 38 of the bead 31.

A radially thin hub portion 33 of the bead 31 entirely surrounds and very firmly grips the central conductor 21. As illustrated, all or most of the forward or frontal end of the hub 33 may be typically embedded in the center conductor 21, whose forward half is preferably larger in diameter than its rearward half. The hub 33 does, however, have a fully exposed, generally planar rearward annular face 33*f*.

The major portion of each vane 32 is a very thin web portion—preferably less than 0.02 inch thick. This web extends most of the radial distance from the hub 33 to the outer conductor 11. In the drawings, the part of the vane with which the reference numerals "32" and "32*f*" are associated is in fact this thin, radially central web portion.

Forming the radially outer end of each vane, in the embodiment of FIG. 1, is a circumferentially broadened foot or base 34—which has a generally planar rearward face 34*f*. This enlarged base 34 at the end of each web 32 provides a greater engagement area for very solidly stabilizing the vane—and thereby the entire support bead 31—against the inside cylindrical surface 13 of the outer conductor 11.

In an embodiment that has these broadened bases 34, preferably each vane tapers smoothly between its web portion 32 and base portion 34 as shown in FIG. 1. This smoothly tapering form appears to be strongly favored by tooling considerations for injection molding.

In operation the tapered form also tends to avoid both mechanical and electrical problems, by minimizing the incidence of small irregularities that can capture foreign materials and introduce small electrical discontinuities. For the same reasons we also prefer to taper each vane 32 outward circumferentially between its web portion 32 and the hub portion 33.

21 At the radially outermost end of each vane 32—and at the radially outer end of the foot or base 34—is formed a boss 35 that is unitary with the material of the vane and extends radially outward. Each boss 35 is aligned with and securely seated in a corresponding one of the three previously mentioned apertures in the outer conductor 11, and from outside the connector is visible within the countersink 14 of the aperture.

Each boss 34 is injection-molded in place in its aperture at the same time the rest of the bead 31 is formed. The boss apertures are quite small—typically only about 0.01 to 0.02 inch in diameter—and are in a part of the connector that is least sensitive electrically to small irregularities. Hence any discontinuities they may introduce are negligible, but they fix the bead very securely in place in the outer conductor.

For clarity of the drawings, in showing the extreme outer surfaces of the bosses 35 as distinct from the outside cylindrical surface 12 of the outer conductor 10, the bosses 35 have been drawn as recessed well within the conical outer portions of the countersinks 14. We prefer, however, to make the outer surfaces of the bosses 35 very nearly flush with the outer surface 12.

This configuration is advantageous because during cooling the plastic shrinks against the conical countersinks, tightening the stuctural attachment very securely. The temperature coefficient of expansion and contraction for the plastic on the order of twice that for the metal. To minimize the likelihood of damage in use, the bosses after cooling should not protrude from the outer surface 12.

Tapering each vane or web 32 into its hub 33 and base 34 does have some slight potential drawbacks. First, as to manufacturing ease and economy, formed along each side of each base 34 is an extremely fine and possibly breakable edge, which could make the injection-molding process slightly more erratic or "fussy" than necessary.

In addition, tiny pieces later broken off from the edges of the bases 34 could find their way into sensitive nearby electrical or mechanical equipment, developing mystifying or (sometimes worse) unnoticed malfunctions in related systems. As to electrical performance, a minor percentage of the desired air space is lost.

Figure 2:
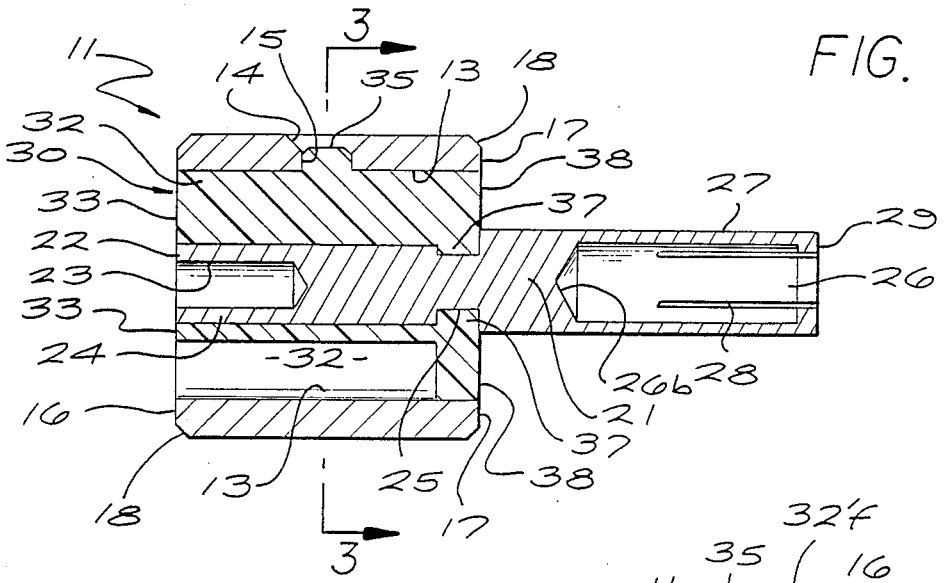
FIG. 2 is a longitudinal section of a similar preferred embodiment.
Figure 3:
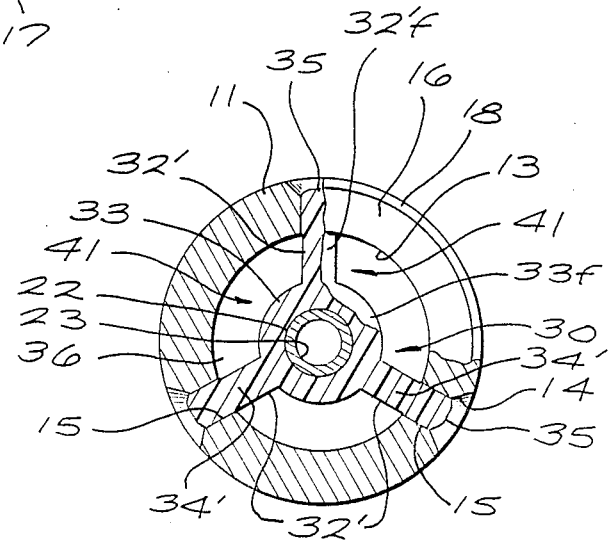
FIG. 3 also shows the FIG. 2 embodiment. The upper right portion of FIG. 3 is an end elevation, and the remainder of the drawing is a broken-away elevational cross-section taken along the line 3—3 in FIG. 2.

Accordingly as shown in FIGS. 2 and 3 our invention encompasses forming the vanes without the broadened outer bases, and also if desired without tapering at either end. Thus in FIGS. 2 and 3 each vane 32' is substantially straight—that is, of constant thickness —all the way out through its foot or base 34' to the inside surface 13 of the outer conductor 11; and each vane 32' also meets the hub 33 in a relatively small-radius corner.

In regard to making a choice between the embodiment of FIG. 1, on the one hand, and the embodiment of FIGS. 2 and 3 on the other hand, some comments may be helpful. A small amount of trial-and-error with both embodiments in a production context will clarify whether one or the other (or some intermediate) is distinctly preferable; and whether one may be better for some applications and the other for other applications.

In other regards, FIGS. 2 and 3 may be taken as illustrating the same embodiment as in FIG. 1, and may clarify some of the earlier discussion of that embodiment. Appearing more clearly in FIGS. 2 and 3, in particular, are the three boss-forming and -gripping apertures 15, with their conical countersink surfaces 14. (As suggested above, the relationship between the countersink surfaces 14 and bosses 35 is drawn somewhat schematically.)

Also appearing more clearly in FIGS. 2 and 3 is the detailed form of the central conductor 21. As these drawings show, that conductor defines a circumferential groove 25, into which projects an internal flange or lip 37 of the support bead 31.

The internal flange 37 is formed by injection molding at the same time as the rest of the bead 31. The groove 25 and internal flange 37 are axially aligned with the wall 36—which is preferably in the extreme forward segment of the bead, to keep dust and other contaminants out of the connector as well as the cable.

Whereas the rest of the bead is partly dielectric material and partly air spaces, the wall 36 is all dielectric and it spans the interior of the outer conductor 10. The wall therefore shifts the characteristic impedance of this forward segment of the connector. To compensate for this shift, the ratio between inner diameter of the outer conductor and outer diameter of the inner conductor must be increased.

We prefer to accomplish this by forming the groove 25 in the inner conductor, because the groove serves double duty. In addition to completely compensating for the impedance shift, the groove engages the internal flange 37 and thereby firmly secures the central conductor 21 against axial motion relative to the bead.

As mentioned earlier, the rear end 22–24 of the central conductor 21 is preferably threaded to receive an adapter that mates with the center conductor of a coaxial cable or other microwave circuit element. If desired, the rear end 22–24 may instead be formed conventionally for connection by soldering, threading, etc.

The outer conductor 11 too may be adapted at its rearward end 16, 18 for electrical connection to the outer braid or other outer conductor (not shown) of a coaxial line or other microwave component. Many conventional arrangements are suitable for this purpose.

Of course the outer conductor must also be adapted for connection to a mating device such as another connector. For this purpose the outer conductor 11 may be, for example, captured within a generally conventional threaded attachment ferrule (not shown) to engage a complementary structure of the mating device. To avoid pin damage, such a ferrule is preferably long enough to provide good alignment between the mating units before the central pins come into engagement.

Another part of our invention, preferably incorporated into the embodiments shown in FIGS. 1 through 3, is a contact element that fits within the frontal bore 26 in the central conductor 21. We prefer to form this contact element as a sheet-metal spring, just long enough to extend axially out of the bore 23—to axially engage the central pin of a mating device.

Figure 4:
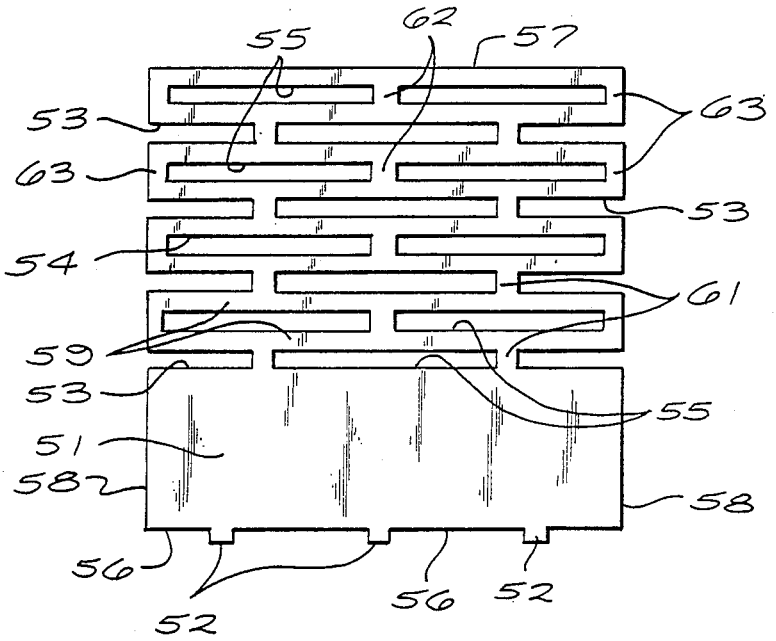
FIG. 4 is a greatly enlarged plan view of a sheet-metal spring contact element for use in the same embodiment, but shown before it is bent to its final configuration for use.
Figure 5:
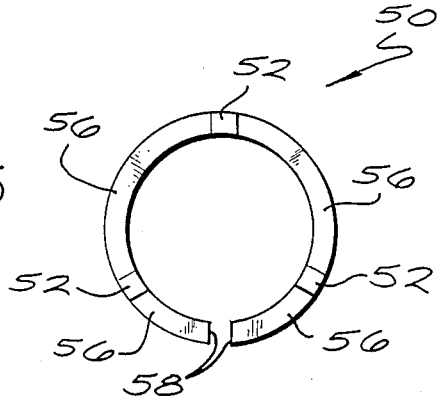
FIG. 5 is an end-on or axial view of the same contact element after bending.

A preferred embodiment of this contact-element spring 50 appears, at preliminary and final stages of fabrication respectively, in FIGS. 4 and 5. The spring is made from a flat piece of thin sheet-metal stock.

The stock is die-cut or otherwise conveniently formed to the generally rectangular shape of FIG. 4, with a rear edge 57 that will be inserted into the central-conductor bore 26 and a front edge 52/56 that will protrude very slightly from the bore. Formed in the front edge are three forward-extending contacts 52.

A frontal portion of the metal sheet, just behind the front edge and extending rearward for roughly a third of the complete length of the sheet, is a forward skirt 51. This uninterrupted segment will give the forward end of the spring some structural integrity as a cylinder, to maintain the contacts in a well-defined relationship to each other and to the mating surface.

A pattern of perforations is etched or otherwise formed into roughly the rear two-thirds of the sheet. As will become apparent, a great variety of patterns could serve for this purpose, as long as they are sufficiently symmetrical, or otherwise chosen, to prevent undesired twisting, binding or other potentially troublesome distortions of the finished spring within the central-conductor bore.

The particular pattern we prefer satisfies these constraints. It consists of four units appearing in a fixed sequence several (preferably four) times between the forward skirt 51 and the rear edge 57. The first unit consists of rectangular cuts 53 that extend inward from the left and right edges 58, each extending not quite one-quarter of the overall width of the sheet; and a central rectangular cut or aperture 55 that extends across the middle of the sheet, not quite halfway across.

Between the aperture 55 and the side cuts 53 on each side remain two thin longitudinal strips 61. Only these two longitudinal strips 61 separate the forward skirt 51 from the rearward portions of the pattern.

The second unit 59 in the pattern is an uninterrupted transverse strip that extends all the way across the metal sheet from one edge to the other. This transverse strip 59 is connected to the forward skirt 51 by the two longitudinal strips 61 just mentioned.

The third unit in the pattern is analogous to the first, but offset laterally by one-quarter the width of the sheet. Thus it has two apertures, each extending not quite halfway across the sheet, separated by a thin longitudinal strip 62.

Along the left and right edges of this third unit in the pattern are respectively two other thin longitudinal strips 63. These two edge strips 63 and the central strip 62 are all that hold the above-mentioned full-width transverse strip 59 to the rearward portions of the pattern.

The fourth unit in the pattern is identical to the second—namely, a full-width transverse strip 59. This strip of course interconnects with the three longitudinal strips 62 and 63, and completes one cycle of the pattern. As can be seen from FIG. 4, we prefer to repeat this cycle three times, for a total of four cycles.

Each unit in this pattern (and therefore the overall spring) has even symmetry laterally, and therefore the spring after being rolled up also has even symmetry transversely. Little transverse-mode resonance develops in this part of the device, however, as electrical leakage into the interior of the central-conductor bore is insignificant. Should such problems arise in special applications, a person skilled in the art and in the teaching of this document can readily substitute a spring pattern with odd symmetry.

After formation according to FIG. 4, the sheet is rolled tightly over a round mandrel to form a generally cylindrical shape (FIG. 5) in which the two originally opposite edges 58 are spaced only slightly apart. The contacts 52 are so arranged along the front edge 56 of the rectangular metal sheet that, after the spring is bent to the shape shown in FIG. 5, the contacts 52 will be arrayed very nearly equilaterally about the circumference of the cylinder.

The spring should be rolled to a free diameter slightly larger than the internal diameter of the axial bore 26 in the central conductor 21. Accordingly with slight transverse compression the spring fits into the axial bore 26, and after insertion can be released (and uncurled) slightly to very gently but positively engage the interior of the bore 26.

As this engagement is very gentle, even if the skirt 27 is slotted, only negligible dimensional variation of the skirt results. Furthermore the spring pressure is very consistent from unit to unit, further minimizing uncontrolled variations.

Obtaining the correct spring-constant relationships is also important. The spring has two different spring constants: one for its uncurling action against the inside of the bore 26, and the other for its axial contact-engaging action.

The latter in turn must actually provide two force components' one to overcome the static friction produced by the uncurling action, so that the forward end of the spring can move axially within the bore; and a second to firmly press the contact areas 52 against the mating pin. These relationships make it even more important to use very gentle engagement of the spring with the inside of the bore 26—which is to say, a very light spring constant for the uncurling action.

Thus only a very small axial force component is needed to overcome static friction. The contrary strategy (raising the axial spring constant to overcome a stiff uncurling action) would instead escalate force levels within the pin and reintroduce difficult problems of dimensional variation.

If desired the spring can be cemented to the bottom (that is, the blind end) **26*b* of the bore 26**. Friction developed by the transverse spring action, however, is ordinarily sufficient to retain the spring in place.

The spring should be made from an alloy that has good electrical conductivity but is also very springy. The material must be one that retains its springiness well, even after being held in compression for protracted periods of time. In other words, it should have good resistance to loss of elasticity or "set."

For this purpose we prefer beryllium copper. Material of thickness 0.002 to 0.004 inch—preferably (0.003-inch shim stock—serves well.

Figure 6:
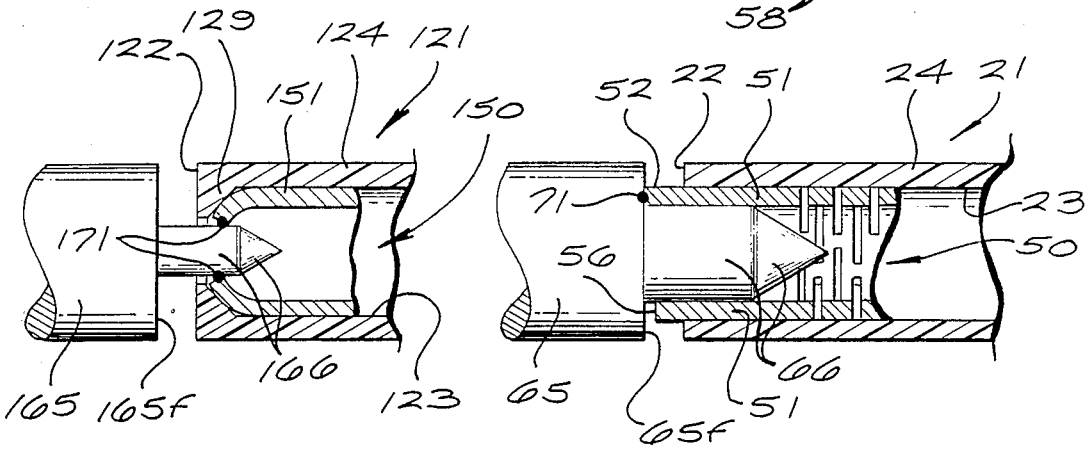
FIG. 6 is a schematic comparative view of the contact regions in the present invention and in the Botka configuration, drawn to very roughly comparable scale.

Shown in the right-hand portion of FIG. 6 is the front end 51, 52, 56 of the finished spring 50, positioned in the central-conductor bore 26. (The connector orientation in this drawing is opposite that in FIGS. 1 and 2.) The rear edge 56 (FIG. 4) of the spring seats against the blind interior end **26*b* (FIG. 2) of the bore 26**.

The front edge 56 and contacts 52 protrude forward past the forward face 29 of the central conductor 21, to engage the planar face 66*f* of a mating-connector-device central pin 65. If desired, that central pin 65 may carry a central extension or tip 66, turned down to a smaller diameter and conventionally pointed at its end, as recited in some well-known industrial or military specifications.

If such a tip 66 is provided, however, it should make a loose slip fit with the cylindrical inside surface of the spring 50, so that substantially no lasting dimensional variation arises from inserting the extension 66 into the spring 50 and bore 26—whether or not the forward skirt 27, 29 of the central conductor 21 has optional slots 28.

Accordingly this system substantially precludes impedance variations of the type mentioned in the previously discussed Botka paper. In some circumstances the spring 50 may also possibly serve to some slight degree as a protective inner shield, redistributing insertion forces and thereby protecting the skirt 27, 29 against even temporary distortion during insertion.

Now it can be appreciated from the right side of FIG. 6 that the contact points 71 for the present invention are separated radially from the outside diameter of the central conductors 21, 65 by only a very short distance. More specifically, the radial separation is only the annular thickness of the wall 27 surrounding the central bore 26.

The depth of the annular gap between the mating pins thus equals only that wall thickness; this shallow annular gap accordingly presents a very short current path and represents a very small inductance. By contrast, the design shown at the left in FIG. 6 as previously mentioned presents a much deeper annular gap and current path, representing a large inductance.

Furthermore, the contact points 71 are essentially out in the open, at the point of intersection of the metal contacts 52 (FIGS. 4 through 6) with the mating face 65*f*. We prefer to make the contacts 52 exceedingly short (on the order of 0.003 inch) in the axial direction, nominally yielding negligible electrical leakage between the recessed edges 56 (FIGS. 4 through 6) of the spring and the mating-pin face 65*f*.

The configuration in the left side of FIG. 6, however, characteristically makes electrical contact at points 171 that are within the central-conductor bore 126 —and, more importantly, within the inward-projecting lip or flange 129*i*. The mating-device central conductor 165 has a tip 166 that must actively participate in making the connection (it cannot be merely a passive tip).

Here the contact points 171 are inside the inward flange 129*i*, and inside the spring 150—and therefore must be radially separated from the outside diameter of the central conductors 121, 165 by two metal thicknesses, plus the clearance and curvature dimensions of the spring 150 and tapered lip 129.

(It will be appreciated that for very rough comparative purposes on a common conceptual basis, we are here reducing both configurations to a common scale This common scale in turn is based generally on the understanding that common dimensions are desirable for pin diameters, wall thicknesses, sheet-metal spring thicknesses, and so forth.)

Stated in other terms, the effective diameter of the mating structure is that of the pin 166, rather than the outer surface of the spring In the present invention, by contrast, as stated earlier the radial separation of the contacts from the outside diameter of the central conductor is only one metal thickness; and the effective diameter of the mating structure is the outside diameter of the spring.

Inductances of these two configurations are significantly different Even though the spring thickness is quite small, generally 0.003 inch, the difference in diameters is twice this or about 0.006 inch —and the entire central-conductor diameter is only about 0.03 inch.

Consequently the difference represents about twenty percent of the overall diameter of the central conductor, or perhaps roughly thirty-five percent of the diameter of the smaller connecting-pin tip 166 in the Botka configuration. In terms of resulting inductances, this fractional increase in diameter is quite significant.

With this discussion in mind, the person skilled in the art will appreciate that other modifications of the illustrated spring geometry may enhance performance. In particular, we consider potentially desirable a secondary flaring (not illustrated) of the forward portion of the spring—after it has been curled into a cylinder.

The objective of such flaring is to make the diameter of the cylinder at the forward edge 56, with its spaced contacts 52, slightly larger than the diameter of the same cylinder further rearward. In particular, the spring diameter at the forward edge can thereby be made to very nearly approach the outside diameter of the central conductor 22. A refined shaping of the forward silhouette of the spring blank may be helpful in such an optimization.

Alternative techniques could also be useful for making the electrically effective outer edge of the electrical-contact pattern or footprint more nearly flush with the outside diameter of the central conductor. For example, the discrete contact points could be defined on the mating surface—e. g., on surface 65*f* of FIG. 6—rather than on the forward edge of the spring. A mating continuous contact ring could then be affixed outside the cylindrical surface of the curled spring.

Such configurations would offer even less inductive discontinuity, but must be carefully optimized to avoid opening an excessive gap between the opposing curled edges of the spring, at its forward edge. Care must also be taken to maintain structural and dimensional integrity, since as will be recalled a very small dimensional variation generates unacceptably large reactive variation.

While we have illustrated and discussed a simple rectangular pattern for the cylindrical sheet-metal spring, more elaborate patterns such as spirals may possibly be made useful. We have chosen three-point engagement for the spring contacts 52 because, as mentioned earlier, three-point engagement has the classical kinematic advantage; however, it is possible that, e. g., five-point engagement might carry some benefits.

All other things being equal, a high-temperature plastic is preferable for a support bead. In continuous operation, most of the heat electrically dissipated in the bead tends to remain and accumulate there.

Resulting temperature escalation can deform or even melt the bead, severely degrading or even interrupting overall system performance. Unfortunately, however, high-temperature plastics typically have higher dielectric constants than lower-temperature materials.

Our invention reduces dielectric loss by introducing large air spaces and minimizing current that circulates in transverse resonances. This loss reduction in turn permits molding the bead from a material whose dielectric constant is slightly higher than the usual. We prefer the high-temperature plastic available from the General Electric Company under the trade name "Ultem 6000."

As is well known in the microwave field, standard air-line sizes for various frequencies include 7 mm for 18 GHz, 3.5 mm for 34 GHz, 2.9 mm for 44 GHz, 2.4 mm for 50 GHz, and 1.85 mm for 65 GHz; the present invention is suitable for use in all or nearly all of such sizes.

Representative approximate dimensions of our preferred embodiment for a 2.9 mm air line include the following.

| | inch | mm |
|---|---|---|
| outer-conductor inside diameter | 0.11 | 2.9 |
| hub outside diameter | 0.06 | 1.5 |
| central conductor | | |
| forward-segment outside diameter | 0.05 | 1.3 |
| forward-segment inside diameter | 0.045 | 1.1 |
| rear-segment outside diameter | 0.03 | 0.8 |
| rear-segment inside diameter | 0.024 | 0.6 |
| spring thickness | 0.003 | 0.08 |

It will be understood that the foregoing disclosure is intended to be merely exemplary, and not to limit the scope of the invention—which is to be determined by reference to the appended claims.

We claim:

1. A microwave coaxial connector usable at a signal frequency band above 10 GHz, as well as lower frequencies, with reduced cavity-mode resonance within the connector at the signal frequency; and comprising:
- an annular outer conductor;
- a central conductor, at least partially disposed within the outer conductor; and
- a support bead for holding the central conductor substantially coaxially within the outer conductor;
- wherein the support bead:
  - is a unitary article injection-molded in position between the conductors,
  - comprises three support vanes extending radially between the outer and central conductors for significantly reducing resonance in even-symmetry modes at the signal frequency band,
  - three air spaces between the vanes, and
  - comprises a hub tightly encircling the central conductor and integrally molded with the vanes;
- whereby the three-vane support bead systematically shifts moding resonance away from the signal frequency toward higher frequencies.

2. The connector of claim 1, wherein:
- the support vanes are symmetrically disposed about the common hub.

3. The connector of claim 1, wherein:
- the bead is of a high-temperature plastic.

4. The connector of claim 1, wherein:
- the bead comprises a dielectric wall that spans the outer conductor and shifts the impedance;
- the central conductor has a groove, raising the outer- to inner-conductor diameter ratio; and
- the bead has a flange that fills the groove;
- whereby the impedance shift is compensated, and the bead is axially stabilized.

5. A microwave coaxial connector comprising:
- an annular outer conductor;
- a central conductor, at least partially disposed within the outer conductor; and
- a support bead for holding the central conductor substantially coaxially within the outer conductor;
- wherein the support bead:
  - is a unitary article injection-molded in position between the conductors,
  - comprises an odd number of support vanes extending radially between the outer and central conductors, and
  - defines an odd number of air spaces between the vanes; and
- wherein each support vane:
  - has a radially outer end and a radially central portion,
  - comprises at its radially outer end a base that is relatively broad circumferentially, for firm engagement with an inner surface of the outer conductor,
  - comprises in its radially central region a relatively narrow web portion, leaving the greater part of the circumference of the annular space between the conductors for said air spaces, and
  - tapers smoothly between its relatively narrow web and its relatively broad base.

6. The connector of claim 5, wherein:
- the support bead further comprises a generally cylindrical radially innermost hub portion that is common to all the vanes and is substantially continuous circumferentially, for firm engagement about an outer surface of the central conductor; and
- each support vane tapers smoothly between its relatively narrow web and the common hub portion.

7. A microwave coaxial connector comprising:
- an annular outer conductor;
- a central conductor, at least partially disposed within the outer conductor; and
- a support bead for holding the central conductor substantially coaxially within the outer conductor;
- wherein the support bead:
  - is a unitary article injection-molded in position between the conductors,
  - comprises an odd number of support vanes extending radially between the outer and central conductors, and
  - defines an odd number of air spaces between the vanes;
- wherein the outer conductor defines an odd number of apertures that are substantially aligned circumferentially with the vanes; and
- wherein each vane comprises a unitary radially outward extending boss that is securely seated in a corresponding one of the apertures;

8. The connector of claim 7, wherein:
- the boss of each vane is injection-molded in place in its aperture.

9. A microwave coaxial connector, usable at a signal frequency band above 10 GHz, as well as lower frequencies, with reduced cavity-mode resonance within the connector at the signal frequency; and for use with a mating device that has a central pin; said coaxial connector comprising:
- an annular outer conductor;
- a central conductor, at least partially disposed within the outer conductor; and
- a support bead that holds the central conductor substantially coaxially within the outer conductor and that:
  - is a unitary article injection-molded in position between the conductors,
  - comprises three support vanes extending radially between the outer and central conductors for significantly reducing resonance in even-symmetry modes at the signal frequency band, defines three air spaces between the vanes, and comprises a hub tightly encircling the central conductor and integrally molded with the vanes;

means for effecting positive plural mechanical and electrical contacts between the central conductor and such central pin without interference fit of either into the other and without interference fit of such pin into the contact-effecting means;

the electrical contact being primarily by axial force of abutment between such central pin and the plural contact-effecting means;

whereby neither the central conductor nor such central pin undergoes expansion upon contact; and whereby the reactance of the combined coaxial connector and such mating device is substantially independent of axial clearances internal to the central conductor.

10. The connector of claim 9, wherein the contact-effecting means comprise a contact element which:

is positioned partially within the central conductor; and comprises a portion that protrudes, and is biased, outward axially from the central conductor for contact outside the central conductor with such central pin of such mating device.

11. The connector of claim 10, wherein:

the outward-extending, outward-biased portion of the contact element forms at least three well-defined contact areas of relatively small circumferential extent.

12. The connector of claim 10, wherein:

the central conductor defines along its axis a bore that is open axially in a direction toward a mating connector; and the contact element comprises a sheet-metal spring that is bent into a generally cylindrical or spiral shape for insertion into the axial bore.

13. The coaxial connector of claim 1, for use with a mating device that has a central pin; said coaxial connector further comprising a contact element which:

is positioned partially within the central conductor; and comprises a portion that extends, and is biased, outward axially from the central conductor for contact with such central pin of such mating device.

14. The connector of claim 13, wherein:

the outward-extending, outward-biased portion of the contact element forms at least three well-defined contact areas of relatively small circumferential extent.

15. The connector of claim 13, wherein:

the central conductor defines along its axis a bore that is open axially in a direction toward such mating device; and the contact element comprises a sheet-metal spring that is bent into a generally cylindrical or spiral shape for insertion into the central bore.

16. The connector of claim 15, wherein:

the sheet-metal spring is shaped along one edge to form at least three well-defined contact areas, of relatively small circumferential extent, in the outward-extending, outward-biased portion of the contact element.

17. The connector of claim 1, wherein:

the support bead further comprises a generally cylindrical radially innermost hub portion that is common to all the vanes and is substantially continuous circumferentially, for firm engagement about an outer surface of the central conductor.

18. The connector of claim 17, wherein:

the inside diameter of the outer conductor is roughly 0.11 inch;

the outside diameter of the hub portion is roughly 0.06 inch;

the outside diameter of the central conductor within the hub is roughly 0.03 inch.

19. A microwave coaxial connector, for use with a mating device that has a central pin; said coaxial connector comprising:

an annular outer conductor;

a central conductor, at least partially disposed within the outer conductor; and a support bead for holding the central conductor substantially coaxially within the outer conductor; and means for effecting positive mechanical and electrical contact between the central conductor and such central pin, without interference fit of either into the other and without interference fit of such central pin into the contact-effecting means, at a number of well-defined contact areas of relatively small circumferential extent;

the electrical contact being primarily by axial force of abutment between such central pin and the contact-effecting means, at the contact areas;

whereby neither the central conductor nor such central pin undergoes expansion upon contact; and whereby the reactance of the combined coaxial connector and such mating device is substantially independent of axial clearances internal to the central conductor.

20. The connector of claim 19, wherein:

the number of contact areas is three.

21. The connector of claim 19, wherein:

the central conductor defines along its axis a bore that is open in a direction toward such mating device; and the contact-effecting means comprise a sheet-metal spring that is bent into a generally cylindrical or spiral shape for insertion into the axial bore;

said central-conductor bore having a mouth portion where the bore is open toward such mating device, and a throat portion within the bore from the mouth portion; the diameter of the mouth portion being at least as large as the diameter of the throat portion; and whereby said bore is formable without undercut tooling and without molding a reentrant cavity.

22. A microwave coaxial connector for use with a mating device that has a central pin; said coaxial connector comprising:

an annular outer conductor;

a central conductor, at least partially disposed within the outer conductor; and a support bead for holding the central conductor substantially coaxially within the outer conductor; and means for effecting positive mechanical and electrical contact between the central conductor and such central pin, substantially without interference fit of either into the other, at a number of well-defined contact areas of relatively small circumferential extent;

whereby neither the central conductor nor such central pin undergoes substantial expansion upon contact; and whereby the reactance of the combined coaxial connector and such mating device is substantially independent of axial clearances internal to the central conductor;

wherein the contact area are disposed outside the central conductor and in axial contact with an exposed face of the mating device central pin; and wherein the contact areas lie along a circumferential pattern whose diameter is very nearly equal to the outside diameter of the central conductor within the connector.

23. A microwave coaxial connector, for use with a mating device that has a central pin; said coaxial connector comprising:

an annular outer conductor;

a central conductor, at least partially disposed within the outer conductor, having an axis and defining along its axis a bore that is open axially in a direction toward such mating device; and a support bead for holding the central conductor substantially coaxially within the outer conductor; and a contact element comprising a sheet-metal spring that is bent into a generally cylindrical or spiral shape for insertion into the axial bore;

wherein a portion of the contact element protrudes outward axially from the central conductor for contact outside the central conductor with such central pin of such mating device.

24. The connector of claim 23, wherein:

the outward-protruding portion of the contact element forms an umber of well-defined contact areas of relatively small circumferential extent; and the spring biases the contact areas toward such central pin of such mating device.

25. The connector of claim 23, wherein:

the number of contact areas is three.

26. The connector of claim 23, wherein:

the sheet-metal spring is shaped along one edge to form at least three well-defined contact areas, of relatively small circumferential extent; and the outward-protruding portion of the contact element comprises the shaped edge of the spring;

whereby the sheet-metal spring biases its own outward-protruding shaped edge toward contact with such central pin of such mating device.

27. The connector of claim 23, wherein:

the internal diameter of the central conductor axial bore is roughly 0.024 inch; and the spring is roughly 0.002 to 0.004 inch thick, and is formed from a metal, such as beryllium copper, that has good resistance to set and has good electrical conductivity.

28. A microwave coaxial connector usable at ultrahigh frequencies above 10 GHz, as well as lower frequencies; and comprising:

an annular outer conductor having an inside diameter selected for operation at ultrahigh frequencies above 10 GHz, as well as lower frequencies;

a central conductor, at least partially disposed within the outer conductor; and a unitary support bead of high-temperature material, injection molded in position between the two conductors, for holding the central conductor substantially coaxially within the outer conductor, and comprising support vanes extending radially between the outer and central conductors; and air spaces defined between the vanes;

wherein the outer conductor defines apertures that are substantially aligned circumferentially with the vanes; and wherein each vane comprises a unitary radially outward extending boss that is securely seated in a corresponding one of the apertures.

29. The connector of claim 28, wherein:

the high-temperature material is material such as that available commercially from the General Electric Company under the trade name "Ultem 6000".

30. The connector of claim 28, wherein:

the central conductor defines an annular groove; and the support bead comprises an inward-projecting ridge that is securely seated in the annular groove.

31. The connector of claim 30, wherein:

the high-temperature material is material such as that available commercially from the General Electric Company under the trade name "Ultem 6000".

* * * * *